US009946207B2

(12) United States Patent
Takemura et al.

(10) Patent No.: US 9,946,207 B2
(45) Date of Patent: Apr. 17, 2018

(54) IMAGE FORMING APPARATUS

(71) Applicant: CANON KABUSHIKI KAISHA, Tokyo (JP)

(72) Inventors: Taichi Takemura, Abiko (JP); Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/220,302

(22) Filed: Jul. 26, 2016

(65) Prior Publication Data

US 2017/0038719 A1 Feb. 9, 2017

(30) Foreign Application Priority Data

Aug. 4, 2015 (JP) ..... 2015-154349

(51) Int. Cl.
*G03G 15/00* (2006.01)

(52) U.S. Cl.
CPC ..... *G03G 15/55* (2013.01); *G03G 15/5062* (2013.01); *G03G 2215/00569* (2013.01); *G03G 2215/0161* (2013.01)

(58) Field of Classification Search
CPC ..... G03G 15/5058; G03G 15/5062
See application file for complete search history.

(56) References Cited

U.S. PATENT DOCUMENTS 7,509,065 B2 3/2009 Itagaki

*Primary Examiner* — Erika J Villaluna
(74) *Attorney, Agent, or Firm* — Canon U.S.A., Inc. IP Division

(57) ABSTRACT

An image forming apparatus includes a conversion unit, an image forming unit, a controller, a conveyance unit, a measurement unit, a determination unit, an adjustment unit, and a generation unit. The conversion unit converts image data based on conversion condition. The image forming unit forms and fixes an image to a sheet. The controller controls to create first and second test sheets having respective reference and measurement images. The first and second test sheets are conveyed. The test images are measured. The determination unit determines first and second information regarding positions. The adjustment unit adjusts an image forming condition based the measured test images. The conversion condition is generated based on a second measurement result. A first reference image length in a direction in which the first test sheet is conveyed is longer than a second reference image length in a direction in which the second test sheet is conveyed.

20 Claims, 12 Drawing Sheets

EXAMPLES OF DETECTION SIGNALS

IMAGE FORMING APPARATUS

BACKGROUND OF THE INVENTION

Field of the Invention

The present invention relates to image quality adjustment control of an image forming apparatus.

Description of the Related Art

An image forming apparatus of an electrophotographic method forms an electrostatic latent image on a photosensitive member based on input image data, develops the electrostatic latent image using a developer, and forms, on a sheet, the image on the photosensitive member. Then, the image forming apparatus conveys, to a fixing device, the sheet on which the image is formed, and the fixing device fixes the image onto the sheet by applying heat and pressure.

At this time, in order to form an image having a target density on a sheet, the image forming apparatus performs image quality adjustment control. An image forming apparatus discussed in U.S. Pat. No. 7,509,065 fixes measurement images formed on a sheet to the sheet, then measures the measurement images on the sheet using a sensor, and adjusts image forming conditions based on the measurement results.

This image forming apparatus forms, on the sheet, reference images different from the measurement images, and based on the results of the sensor detecting the reference images, determines the timing when the measurement images on the sheet reach the measurement position of the sensor. Through this operation, even if the timing when the sheet enters the measurement position of the sensor shifts, the image forming apparatus prevents the sensor from erroneously detecting the measurement images.

Incidentally, the image quality adjustment control includes maximum density adjustment control for controlling a maximum density to be a target maximum density, and gradation adjustment control for controlling the gradation characteristics of the image forming apparatus to be ideal gradation characteristics. In the image quality adjustment control, first, the maximum density adjustment is executed to determine image forming conditions for forming an image having the target maximum density. Then, the gradation adjustment control is executed.

However, the amount of developer of the reference images developed in the maximum density adjustment control may be so large that the fixing device cannot completely fix the reference images onto the sheet. This is because the amount of developer to be attached to the electrostatic latent image changes due to environment conditions such as temperature and humidity, and the amount of charge of the developer.

If the fixing device cannot completely fix the developer of the reference images, part of the developer of the reference images is not fixed to the sheet and comes off. As a result, the sensor may not be able to detect the reference images, and it may not be possible to determine with high accuracy the timing when the measurement images on the sheet reach the measurement position of the sensor.

SUMMARY OF THE INVENTION

According to an aspect of the present invention, an image forming apparatus includes a conversion unit configured to convert image data based on a conversion condition, an image forming unit configured to form an image based on the image data converted by the conversion unit and fix the image to a sheet, a controller configured to control the image forming unit to create a first test sheet and a second test sheet, wherein first reference image and first measurement images are formed on the first test sheet, and second reference image and second measurement images are formed on the second test sheet, a conveyance unit configured to convey the first test sheet and the second test sheet, a measurement unit configured to measure the first reference image and the first measurement images on the first test sheet conveyed by the conveyance unit and measure the second reference image and the second measurement images on the second test sheet conveyed by the conveyance unit, a determination unit configured to determine first information regarding positions of the first measurement images on the first test sheet based on measurement results of the first reference image by the measurement unit and determine second information regarding positions of the second measurement images on the second test sheet based on measurement results of the second reference image by the measurement unit, an adjustment unit configured to adjust an image forming condition based on a first measurement result corresponding to a measurement result of the first test sheet measured by the measurement unit based on the first information, and a generation unit configured to generate the conversion condition based on a second measurement result corresponding to a measurement result of the second test sheet measured by the measurement unit based on the second information, wherein a length of the first reference image in a direction in which the first test sheet is conveyed is longer than a length of the second reference image in a direction in which the second test sheet is conveyed.

Further features of the present invention will become apparent from the following description of exemplary embodiments with reference to the attached drawings.

DESCRIPTION OF THE EMBODIMENTS

<Image Forming Apparatus>

Figure 1:
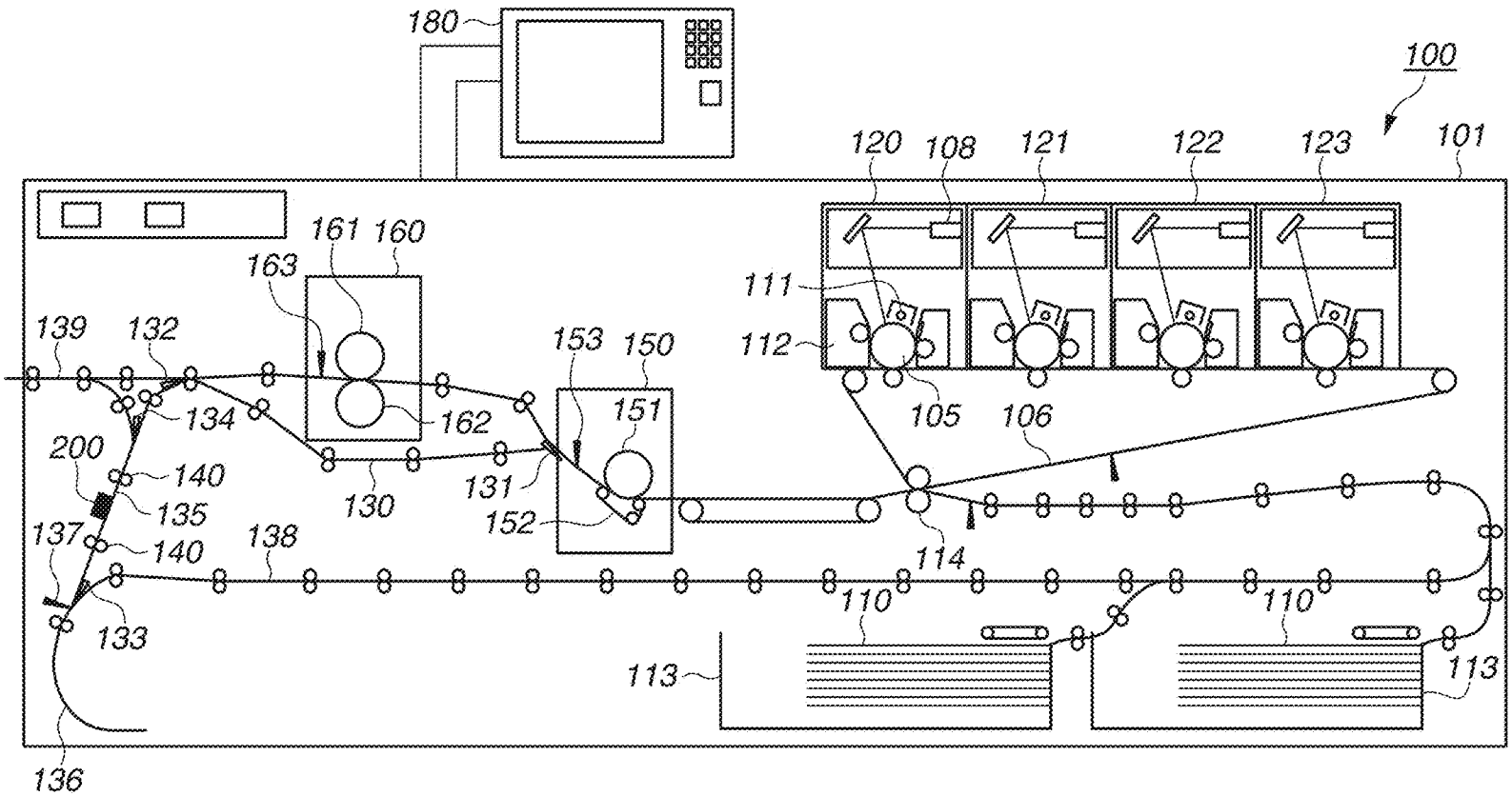
FIG. 1 is a schematic cross-sectional view of an image forming apparatus.

FIG. 1 is a cross-sectional view illustrating a structure of an image forming apparatus 100. The image forming apparatus 100 provides four stations 120, 121, 122, and 123, where each station forms an image. Here, each of the stations 120, 121, 122, and 123 is an image forming unit for forming an image on a sheet 110 using a developer. "Y", "M", "C", and "K" are the abbreviations of yellow, magenta, cyan, and black, respectively, which as part of the CMYK color model.

The station 120 forms a yellow image. The station 121 forms a magenta image. The station 122 forms a cyan image. The station 123 forms a black image. The stations 120, 121, 122, and 123 include almost similar components.

A photosensitive drum 105 is an image bearing member with a photosensitive member formed on the surface of a cylindrical aluminum member. The photosensitive drum 105 is controlled by a driving unit (not illustrated) to rotate at a predetermined rotational speed. A charging device 111 charges the photosensitive drum 105. An exposure device 108 irradiates with laser light the photosensitive drum 105 charged by the charging device 111, thereby forming an electrostatic latent image on the photosensitive drum 105. A developing device 112 develops the electrostatic latent image using a developer containing nonmagnetic toner and magnetic carrier. This forms a toner image on the surface of the photosensitive drum 105. The toner image is transferred onto an intermediate transfer belt 106. Transfer rollers 114 transfer the toner image formed on the intermediate transfer belt 106 onto a sheet 110 conveyed from a sheet feeding unit 113.

The image forming apparatus 100 includes fixing devices 150 and 160, which heat and pressurize the toner image transferred onto the sheet 110, thereby fixing the toner image onto the sheet 110. The fixing device 150 includes a fixing roller 151 for applying heat to the sheet 110, a pressure belt 152 for bringing the sheet 110 into pressure contact with the fixing roller 151, and a sensor 153 for detecting the discharge of the sheet 110 from the fixing device 150. In the fixing roller 151, a heater is provided.

The fixing device 160 imparts gloss to the toner image on the sheet 110 discharged from the fixing device 150, or heats and pressurizes the sheet 110 to secure fixability. Similarly to the fixing device 150, the fixing device 160 also includes a fixing roller 161, a pressure roller 162, and a second post-fixing sensor 163. In the fixing roller 161, a heater is provided.

For example, in a case where the mode of adding gloss to the sheet 110 is executed, or in a case where the sheet 110 is thick paper, the sheet 110 having passed through the fixing device 150 is conveyed also to the fixing device 160. On the other hand, in a case where the sheet 110 is plain paper or thin paper, or in a case where the mode of adding gloss is not executed, the sheet 110 is conveyed to a conveyance path 130, which bypasses the fixing device 160. In the conveyance path 130, a plurality of rollers for conveying the sheet 110 are provided. Further, the image forming apparatus 100 includes a flapper 131, which switches between the conveyance of the sheet 110 to the fixing device 160 and the conveyance of the sheet 110 to the conveyance path 130.

The sheet 110 conveyed along the conveyance path 130 and the sheet 110 discharged from the fixing device 160 are switched by a flapper 132 between the conveyance of the sheet 110 conveyance path to a discharge path 135, and the conveyance of the sheet 110 to a discharge path 139. If the sheet 110 is conveyed to the discharge path 135, conveying rollers 140 convey the sheet 110 toward a reverse unit 136. Then, if a reverse sensor 137 detects the trailing end of the sheet 110, the conveyance direction of the sheet 110 is reversed. A flapper 133 switches between the conveyance of the sheet 110 to a conveyance path 138 for two-sided image formation and the conveyance of the sheet 110 to the discharge path 135.

In the discharge path 135, color sensors 200 are disposed for detecting reference images and measurement images on the sheet 110 conveyed by the conveying rollers 140. Four color sensors 200 are arranged in a direction orthogonal to the conveyance direction of the sheet 110, thereby detecting four rows of reference images and four rows of measurement images that are formed on the sheet 110.

Figure 8:
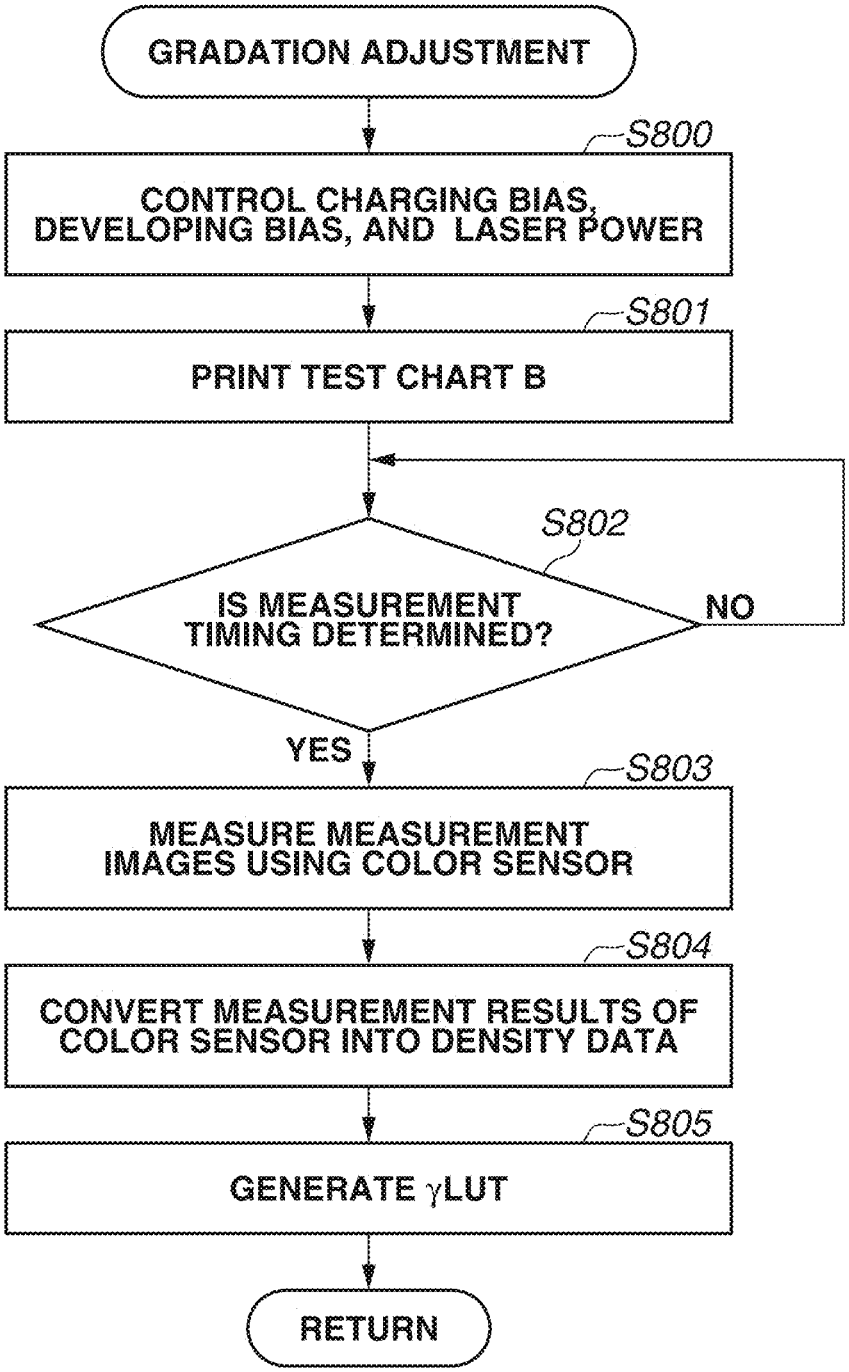
FIG. 8 is a flowchart of gradation adjustment control.

If instructed by an operation unit 180 to execute image quality adjustment control, the image forming apparatus 100 executes maximum density adjustment (FIG. 5) and gradation adjustment (FIG. 8). In a case where the image quality adjustment control is executed, the image forming apparatus 100 conveys the sheet 110 to the conveyance path 135 and measures the reference images and the measurement images on the sheet 110 using the color sensors 200.

A flapper 134 is a guidance member for conveying the sheet 110 to the discharge path 139. The sheet 110 on which the reference images and the measurement images are measured in the image quality adjustment control is guided to the discharge path 139 by the flapper 134 and discharged from the image forming apparatus 100. The sheet 110 conveyed to the discharge path 139 by the flapper 132 is also discharged to outside the image forming apparatus 100.

<Color Sensor>

Figure 2:
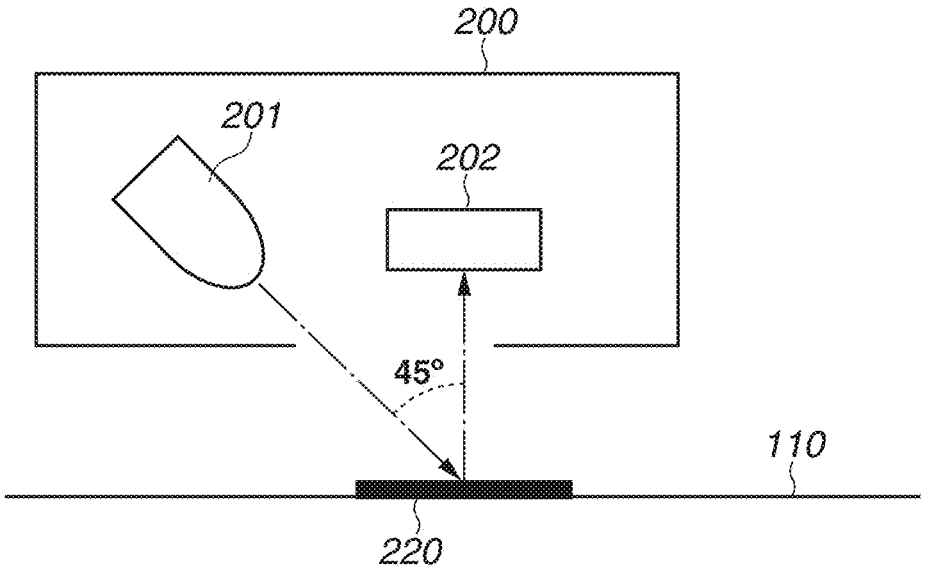
FIG. 2 is a schematic diagram of a main part of a color sensor.

FIG. 2 is a diagram illustrating an example of a configuration of each color sensor 200. In FIG. 2, the color sensor 200 is a sensor for outputting a signal corresponding to the intensity of reflected light from a measurement image 220 fixed to the sheet 110. The color sensor 200 includes a light-emitting element 201 such as a white light-emitting diode (LED), and a charge storage type sensor 202 having red, green, and blue (RGB) on-chip filters. The sensor 202 includes a light-receiving element having a red (R) filter, a light-receiving element having a green (G) filter, and a light-receiving element having a blue (B) filter. The sensor 202 may be configured to include a plurality of sets of three light-receiving elements.

The light-emitting element 201 is placed so that light emitted from the light-emitting element (white LED) 201 is incident on the sheet 110 at an angle of 45°. The sensor 202 is placed in a direction orthogonal to the surface of the sheet 110. Alternatively, the color sensor 200 may be configured in such a manner that the angle of incidence is 0 degrees, and the angle of reflection is 45 degrees. Yet alternatively, the color sensor 200 may include LEDs for individually emitting light of three RGB colors, and a filterless sensor.

RGB output values of the measurement images fixed on the sheet 110 are output from the color sensors 200, and the RGB output values are converted into the densities of the respective measurement images. Then, by the image quality adjustment control, image forming conditions and a $\gamma$ lookup table (LUT) are generated based on the densities of the respective measurement images.

<Control Block Diagram>

Figure 3:
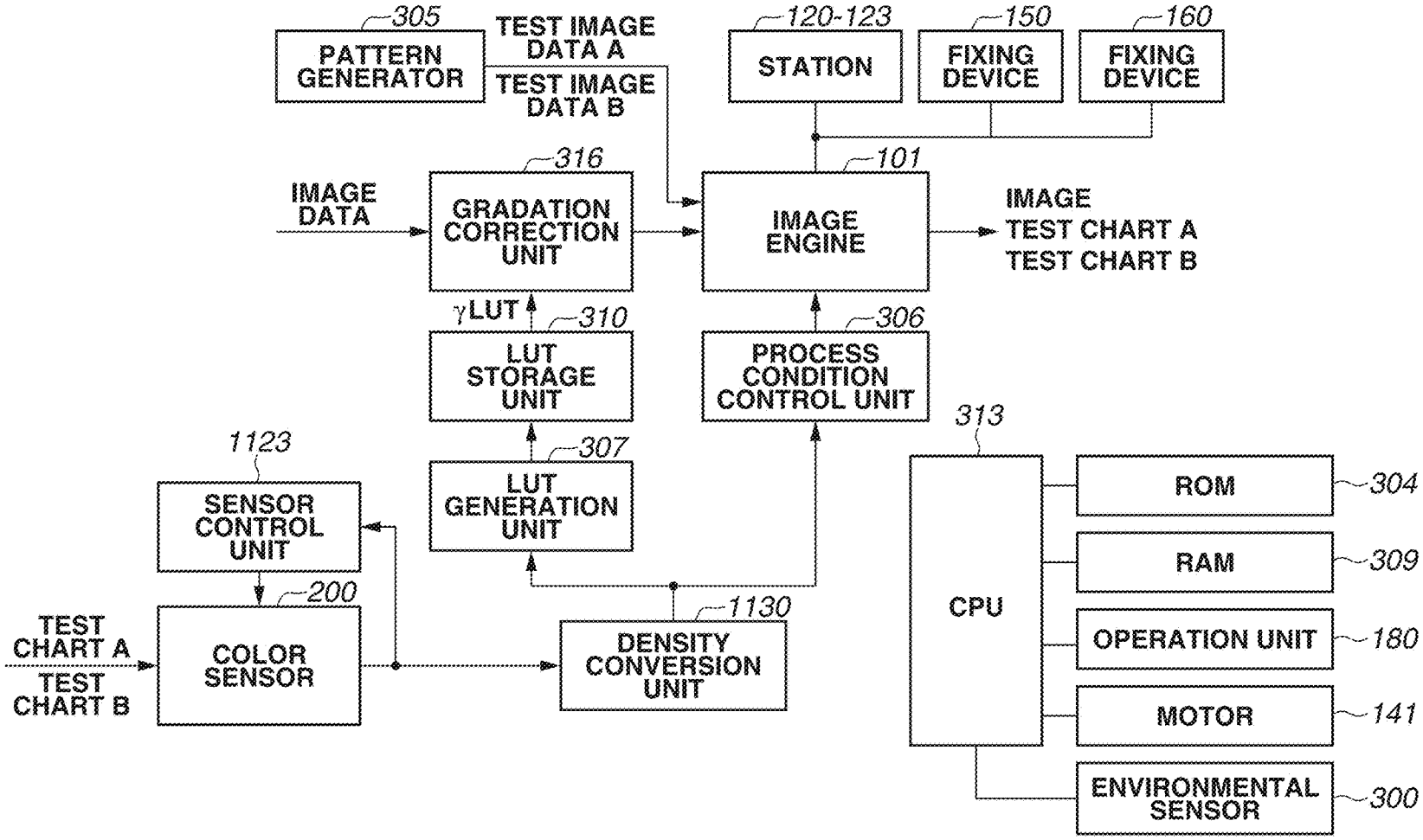
FIG. 3 is a control block diagram of the image forming apparatus.

FIG. 3 is a control block diagram of the image forming apparatus 100. A central processing unit (CPU) 313 is a control circuit for controlling each unit of the image forming apparatus 100. A read-only memory (ROM) 304 stores control programs required to execute various types of processing of flowcharts (described below), which are executed by the CPU 313. A random-access memory (RAM) 309 is a system work memory for the operation of the CPU 313.

A motor 141 is a driving unit for conveyance speed the conveying rollers 140 conveying the sheet 110 at a target conveyance speed. An environmental sensor 300 is a sensor for detecting temperature and humidity around the image forming apparatus 100 and is also a sensor for detecting temperature and humidity within the image forming apparatus 100.

The operation unit 180 is an example of a user interface unit. The operation unit 180 includes a display unit and a key input unit. The operation unit 180 has a function of receiving, via the display unit and the key input unit, an instruction to execute image quality adjustment control. Further, the operation unit 180 has a function of providing, via the display unit, information of the image forming apparatus 100 to a user. The key input unit includes, for example, a start key, which is used to give an instruction to start the execution of scanning or copying, a stop key, which is used to give an instruction to stop the operation of scanning or copying, and a numeric keypad.

The density of an image to be formed by the image forming apparatus 100 changes. In response, a gradation correction unit 316 corrects an input value of image data (image signal value) so that the density of an image to be formed by the image forming apparatus 100 is a desired density. The gradation correction unit 316 corrects the gradation characteristics of the image data based on a γ LUT stored in an LUT storage unit 310. The γ LUT corresponds to a gradation correction table for correcting the input value of the image data.

The gradation correction unit 316 may be achieved by an integrated circuit such as an application-specific integrated circuit (ASIC), or may be achieved by the CPU 313 correcting the image data based on a program stored in advance.

The image data corrected by the gradation correction unit 316 is transferred to an image engine 101. The image engine 101 corresponds to the stations 120, 121, 122, and 123 and the fixing devices 150 and 160. The stations 120, 121, 122, and 123 and the fixing devices 150 and 160 form an image on the sheet 110 based on the image data input to the image engine 101. This image forming operation has been described above and therefore is not described here.

A pattern generator 305 generates test image data for forming test charts A and B. In a case where maximum density adjustment control is executed, the pattern generator 305 outputs the test image data A. In a case where gradation adjustment control is executed, the pattern generator 305 outputs the test image data B. The maximum density adjustment and the gradation adjustment control will be described in detail below with reference to FIGS. 5 to 9.

A density conversion unit 1130 converts sensor output values (digital signals) of the color sensors 200 into the densities (on-paper densities) of the measurement images on the sheet 110. The density of a yellow measurement image is determined based on a sensor output value output from the light-receiving element having the blue filter. The density of a magenta measurement image is determined based on a sensor output value output from the light-receiving element having the green filter. The density of a cyan measurement image is determined based on a sensor output value output from the light-receiving element having the red filter. The density of a black measurement image is determined based on a sensor output value output from the light-receiving element having the green filter.

A process condition control unit 306 controls the image forming conditions of the stations 120, 121, 122, and 123. The image forming conditions include a charging bias to be applied to the charging device 111 to charge the photosensitive drum 105, a developing bias to be applied to the developing device 112 for the developing device 112 to develop an electrostatic latent image using a toner, and the laser power of laser light emitted from the exposure device 108.

In a case where maximum density adjustment control is executed, the process condition control unit 306 determines the charging bias and the developing bias based on the absolute amount of moisture detected by the environmental sensor 300. Then, the image engine 101 prints a test chart A including measurement images based on the same charging bias, the same developing bias, and different laser powers. Sensor output values corresponding to the measurement images on the test chart A measured by the color sensors 200 are converted into densities by the density conversion unit 1130. Based on information of the densities of the measurement images, the process condition control unit 306 determines the laser power of the exposure device 108 for forming an image having a target maximum density.

An LUT generation unit 307 generates a γ LUT, based on which the gradation correction unit 316 corrects the image data. The process condition control unit 305 controls the image forming conditions of the image engine 101, and the image engine 101 prints a test chart B. Sensor output values corresponding to measurement images on the test chart B measured by the color sensors 200 are converted into densities by the density conversion unit 1130. Based on information of the densities of the measurement images, the LUT generation unit 307 generates a γ LUT for correcting the gradation characteristics to ideal gradation characteristics and stores the γ LUT in the LUT storage unit 310.

A sensor control unit 1123 compares sensor output values of the color sensors 200 with a threshold, thereby determining whether reference images are detected. Based on the timing when the reference images are detected, the sensor control unit 1123 determines measurement timing for measuring the measurement images on the sheet 110. Then, the sensor control unit 1123 controls the color sensors 200 to output sensor output values based on the measurement timing. The control in which the sensor control unit 1123 causes the color sensors 200 to output sensor output values based on the measurement timing will be described with reference to FIG. 10 below and therefore is not described here.

Figure 4:
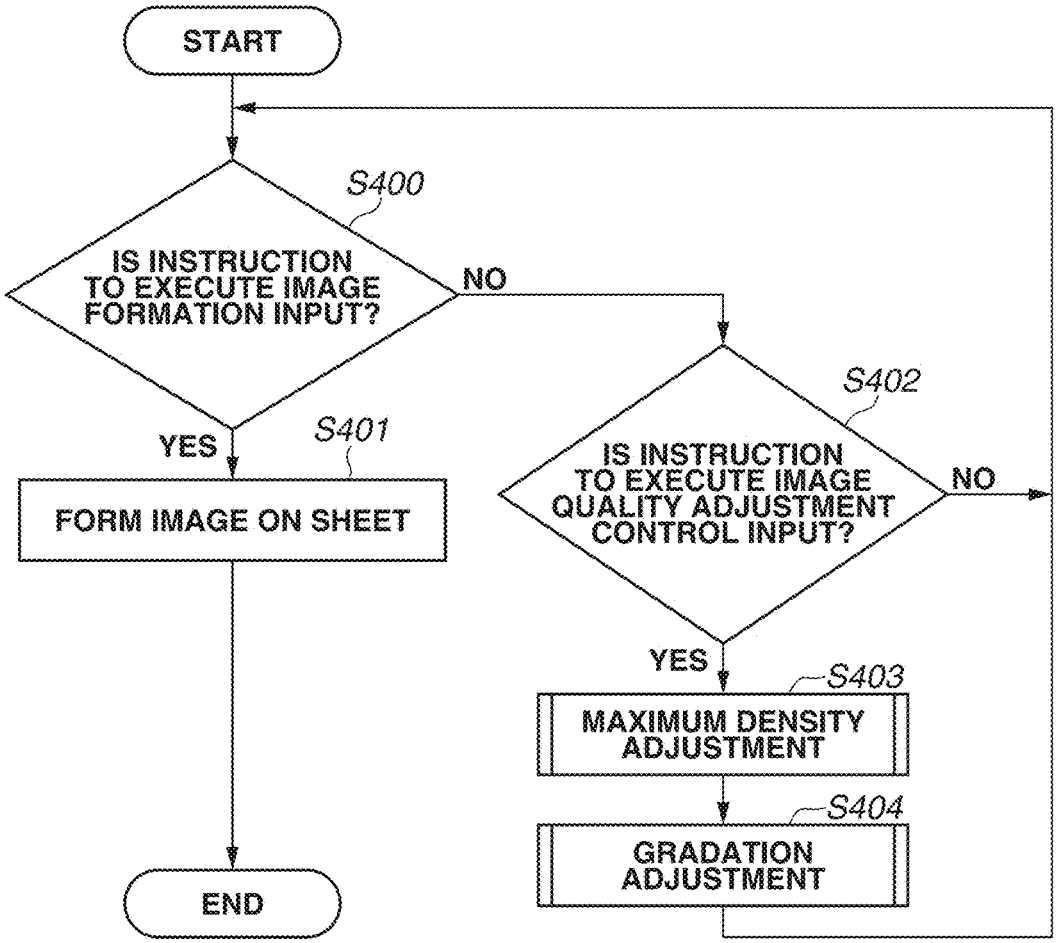
FIG. 4 is a flowchart of an image forming operation.

Next, referring to FIG. 4, the operation of the image forming apparatus 100 is described. After the main power supply of the image forming apparatus 100 is turned on, the CPU 313 reads and executes a control program stored in the ROM 304.

In step S400, the CPU 313 determines whether a signal giving an instruction to execute image formation is input. In step S400, if a start button for starting copying is pressed in the operation unit 180, or image data is input from a personal computer (PC) (not illustrated), the CPU 313 determines that a signal giving an instruction to execute image formation is input. If a signal giving an instruction to execute image formation is input in step S400 (YES in step S400), the processing proceeds to step S401. In step S401, the CPU 313 converts image data based on a γ LUT and forms an image on a sheet based on the converted image data.

In step S401, the gradation correction unit 316 reads a γ LUT stored in the γ LUT storage unit 307 and converts input image data based on the γ LUT. Next, based on the image data output from the gradation correction unit 316, the image engine 101 forms an image on a sheet using the stations 120, 121, 122, and 123 and the fixing devices 150 and 160.

In step S400, if, on the other hand, a signal giving an instruction to execute image formation is not input (NO in step S400), the processing proceeds to step S402. In step S402, the CPU 313 determines whether a signal giving an instruction to execute image quality adjustment control is input. In step S402, if a signal giving an instruction to execute image quality adjustment control is input from the operation unit 180 (YES in step S402), the processing proceeds to step S403. In step S403, the CPU 313 executes maximum density adjustment control. Then, in step S404, the CPU 313 executes gradation adjustment control. Then, the processing proceeds to step S400.

Further, in step S402, if a signal giving an instruction to execute image quality adjustment control is not input (NO in step S402), the processing proceeds to step S400. In other words, the CPU 313 waits until a signal giving an instruction to execute image formation is input, or a signal giving an instruction to execute image quality adjustment control is input.

<Maximum Density Adjustment Control>

Figure 5:
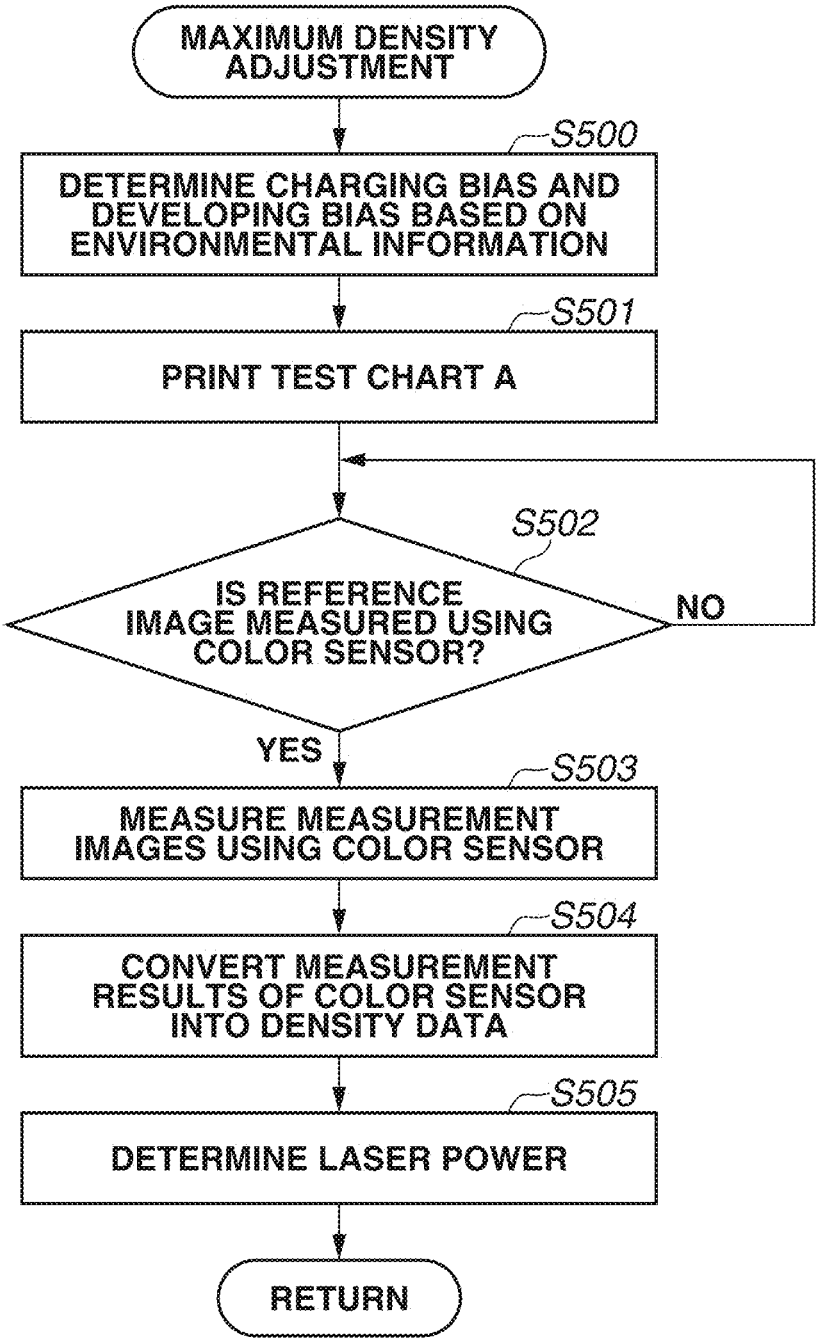
FIG. 5 is a flowchart of maximum density adjustment control.
Figure 6:
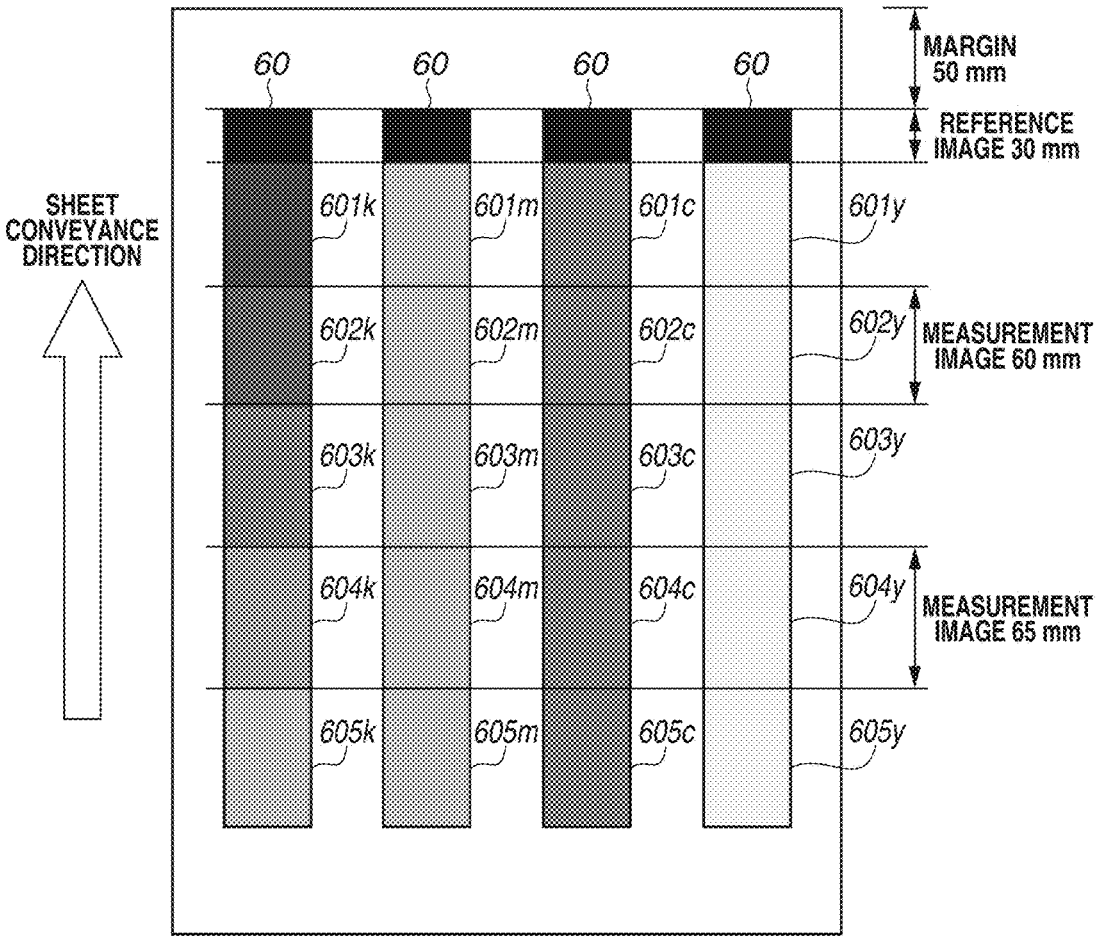
FIG. 6 is a schematic diagram of a test chart A.
Figure 7:
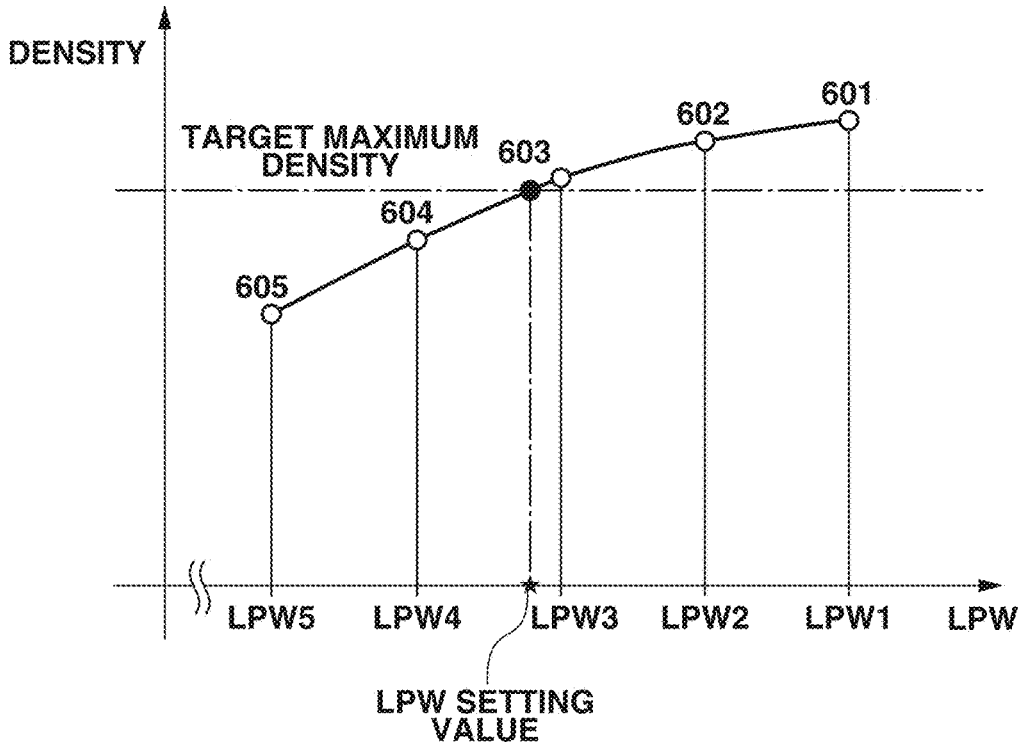
FIG. 7 is a diagram illustrating a method for determining a laser power.

Next, with reference to FIGS. 5, 6, and 7, a description is given of the maximum density adjustment control illustrated in step S403 in FIG. 4. FIG. 5 is a flowchart of the maximum density adjustment control. The maximum density adjustment control is control for determining image forming conditions for forming an image having a target maximum density. The image forming apparatus 100 forms a test chart A including a reference image 60 and measurement images 601, 602, 603, 604, and 605, and each color sensor 200 measures the reference image 60 and the measurement images 601, 602, 603, 604, and 605 while the test chart A is conveyed along the conveyance path 135. Then, based on the measurement results of the color sensors 200, the image forming conditions for forming an image having the target maximum density are determined.

If the maximum density adjustment control is executed, first, in step S500, the CPU 313 controls the process condition control unit 306 to control the charging bias and the developing bias based on the absolute amount of moisture detected by the environmental sensor 300. At this time, the correspondence relationship between the absolute amount of moisture and the charging bias and the correspondence relationship between the absolute amount of moisture and the developing bias are determined in advance by experiment, and data of these correspondence relationships is stored in advance in the ROM 304. The process condition control unit 306 refers to the data stored in the ROM 304 and thereby can determine a charging bias and a developing bias suitable for the current absolute amount of moisture.

Next, in step S501, the CPU 313 causes the pattern generator 305 to output test image data A and causes the image engine 101 to print a test chart A on a sheet based on the test image data A. In step S501, the image engine 101 is controlled based on the charging bias and the developing bias determined in step S500 and forms the reference image 60 and the measurement images 601, 602, 603, 604, and 605 on a sheet.

At this time, image forming conditions for forming the measurement images 601, 602, 603, 604, and 605 have relationships expressed in formula 1.

$$LPW1>LPW2>LPW3>LPW4>LPW5 \quad \text{(formula 1)}$$

where a laser power for forming the measurement image 601 is LPW1, a laser power for forming the measurement image 602 is LPW2, a laser power for forming the measurement image 603 is LPW3, a laser power for forming the measurement image 604 is LPW4, and a laser power for forming the measurement image 605 is LPW5.

FIG. 6 is a schematic diagram of the test chart A. In the conveyance direction in which the sheet is conveyed, the reference image 60 is formed on the leading end side of the sheet with respect to each of the measurement images 601, 602, 603, 604, and 605. Further, a margin is provided between the leading end side of the sheet and the reference images 60.

Measurement images 601*y*, 602*y*, 603*y*, 604*y*, and 605*y* are yellow measurement images formed by the station 120. Measurement images 601*m*, 602*m*, 603*m*, 604*m*, and 605*m* are magenta measurement images formed by the station 121. Measurement images 601*c*, 602*c*, 603*c*, 604*c*, and 605*c* are cyan measurement images formed by the station 122. Measurement images 601*k*, 602*k*, 603*k*, 604*k*, and 605*k* are black measurement images formed by the station 123.

The lengths in the conveyance direction of the margin, the reference image, and the measurement images are as follows.

Margin: 50 millimeter (mm)
Reference image 60: 30 mm
Measurement images 601 and 602: 60 mm
Measurement images 603, 604, and 605: 65 mm Referring back to FIG. 5, after the test chart A is printed in step S501, the CPU 313 controls the motor 141 to convey the test chart A to the conveyance path 135. In step S502, the CPU 313 waits until the sensor control unit 1123 detects the reference image 60 based on a sensor output value output from the color sensor 200. If the reference image 60 is detected (YES in step S502), the processing proceeds to step S503. In step S503, the sensor control unit 1123 determines the measurement timing of the measurement images 601, 602, 603, 604, and 605 based on the detection timing of the reference image 60.

Then, in step S503, based on the measurement timing determined by the sensor control unit 1123, the CPU 313 acquires sensor output values corresponding to the measurement images 601, 602, 603, 604, and 605 from the color sensors 200. In step S504, the sensor output values of the color sensors 200 are converted into the densities of the measurement images 601, 602, 603, 604, and 605 by the density conversion unit 1130, and then, the densities are input to the process condition control unit 306.

Next, in step S505, based on the densities of the measurement images 601, 602, 603, 604, and 605 and the laser powers LPW1, LPW2, LPW3, LPW4, and LPW5, the CPU 313 determines a laser power for forming an image having a target maximum density. FIG. 7 is a diagram illustrating relationships between the laser powers and the densities of the measurement images measured by the color sensors 200. In step S505, based on the relationships between the laser powers and the densities of the measurement images, the process condition control unit 306 determines the laser power (an LPW setting value) for forming an image having the target maximum density using linear interpolation. The process condition control unit 306 interpolates the LPW setting value based on a measurement result having a higher density than the target maximum density (measurement image 603 in FIG. 7) and a measurement result having a lower density than the target maximum density (measurement image 602 in FIG. 7).

Then, the CPU 313 sets in the image engine 101 the LPW setting value, the charging bias, and the developing bias determined by the process condition control unit 306, and ends the maximum density adjustment.

<Gradation Adjustment Control>

Figure 9:
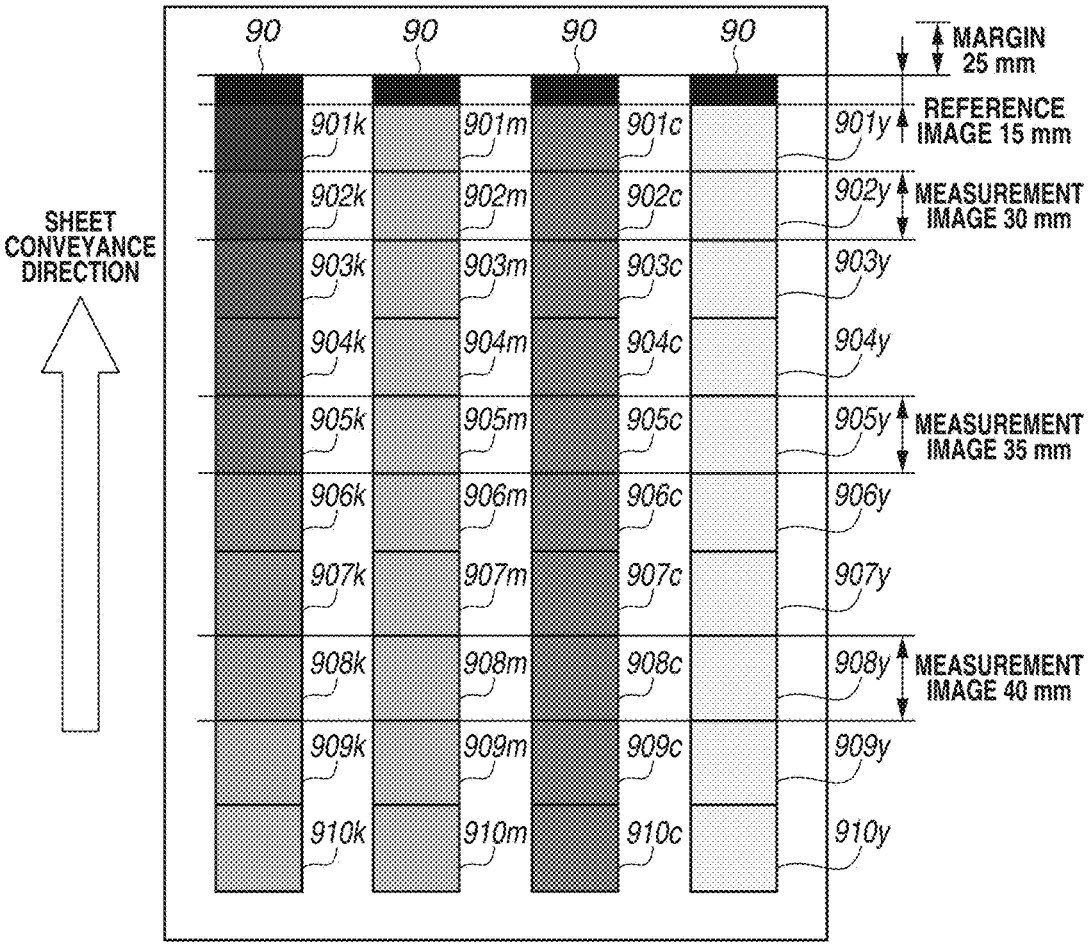
FIG. 9 is a schematic diagram of a test chart B.

Next, with reference to FIGS. 8 and 9, a description is given of the gradation adjustment control illustrated in step S404 in FIG. 4. FIG. 8 is a flowchart of the gradation adjustment control. The gradation adjustment control is control for generating a γ LUT so that the gradation characteristics of an image to be formed on a sheet by the image forming apparatus 100 are ideal gradation characteristics. The image forming apparatus 100 forms a test chart B including a reference image 90 and measurement images 901, 902, 903, 904, 905, 906, 907, 908, 909, and 910. Then, each color sensor 200 measures the reference image 90 and the measurement images 901, 902, 903, 904, 905, 906, 907, 908, 909, and 910 while the test chart B is conveyed along the conveyance path 135. Then, based on the measurement results of the color sensors 200, a γ LUT is generated so that the gradation characteristics of the image forming apparatus 100 are the ideal gradation characteristics.

If the gradation adjustment control is executed, first, in step S800, the CPU 313 controls the charging bias, the developing bias, and the laser power of the image engine 101 to have the values determined by the process condition control unit 306 in the maximum density adjustment control. Then, in step S801, the CPU 313 causes the pattern generator 305 to output test image data B and causes the image engine 101 to print a test chart B based on the test image data B. In step S801, the image engine 101 forms the reference image 90 and the measurement images 901, 902, 903, 904, 905, 906, 907, 908, 909, and 910 on a sheet.

In step S801, the image forming conditions are controlled to be the charging bias, the developing bias, and the laser power setting value determined in step S800. This is to guarantee the maximum density of an image to be formed on a sheet by the image forming apparatus 100.

FIG. 9 is a schematic diagram of the test chart B. In the conveyance direction in which the sheet is conveyed, the reference image 90 is formed on the leading end side of the sheet with respect to the measurement images 901, 902, 903, 904, 905, 906, 907, 908, 909, and 910. Further, a margin is provided between the leading end of the sheet and the reference image 90.

Measurement images 901*y*, 902*y*, 903*y*, 904*y*, 905*y*, 906*y*, 907*y*, 908*y*, 909*y*, and 910*y* are yellow measurement images formed by the station 120. Measurement images 901*m*, 902*m*, 903*m*, 904*m*, 905*m*, 906*m*, 907*m*, 908*m*, 909*m*, and 910*m* are magenta measurement images formed by the station 121. Measurement images 901*c*, 902*c*, 903*c*, 904*c*, 905*c*, 906*c*, 907*c*, 908*c*, 909*c*, and 910*c* are cyan measurement images formed by the station 122. Measurement images 901*k*, 902*k*, 903*k*, 904*k*, 905*k*, 906*k*, 907*k*, 908*k*, 909*k*, and 910*k* are black measurement images formed by the station 123.

The lengths in the conveyance direction of the margin, the reference image, and the measurement images are as follows.

Margin: 25 mm

Reference image 90: 15 mm

Measurement images 901 and 902: 30 mm

Measurement images 903 to 906: 35 mm

Measurement images 907 to 910: 40 mm

Referring back to FIG. 8, after the test chart B is printed in step S801, the CPU 313 controls the motor 141 to convey the test chart B to the conveyance path 135. In step S802, the CPU 313 waits until the sensor control unit 1123 detects the reference image 90 based on a sensor output value output from the color sensor 200. If the reference image 90 is detected (YES in step S802), the processing proceeds to step S803. In step S803, the sensor control unit 1123 determines the measurement timing of the measurement images 901, 902, 903, 904, 905, 906, 907, 908, 909, and 910 based on the detection timing of the reference image 90.

Then, in step S803, based on the measurement timing, the CPU 313 acquires sensor output values corresponding to the measurement images 901, 902, 903, 904, 905, 906, 907, 908, 909, and 910 from the color sensor 200. In step S804, the sensor output values of the color sensor 200 are converted into the densities of the measurement images 901, 902, 903, 904, 905, 906, 907, 908, 909, and 910 by the density conversion unit 1130, and then, the densities are input to the LUT generation unit 307.

Next, in step S805, based on the measurement images 901, 902, 903, 904, 905, 906, 907, 908, 909, and 910, the CPU 313 obtains the gradation characteristics of the image forming apparatus 100 and generates a γ LUT so that the gradation characteristics are ideal gradation characteristics.

Now, the γ LUT is described. For example, it is assumed that in the gradation characteristics of the image forming apparatus 100, the density of a measurement image formed based on an image signal value i is Di, and in the ideal gradation characteristics, a target density of an image signal i is Ditgt. The ideal gradation characteristics are determined in advance by experiment. If an image signal value for forming an image having the same density as the target density Ditgt in the gradation characteristics of the image forming apparatus 100 acquired in the gradation adjustment control is j, the γ LUT is a table for converting the image signal value i into the image signal value j. In step S805, the LUT generation unit 307 linearly interpolates the results of the color sensor 200 measuring the measurement images 901, 902, 903, 904, 905, 906, 907, 908, 909, and 910, thereby acquiring the gradation characteristics of the image forming apparatus 100. Then, the LUT generation unit 307 generates a γ LUT so that the gradation characteristics of the image forming apparatus 100 are the ideal gradation characteristics.

Then, the CPU 313 stores the γ LUT generated by the LUT generation unit 307 in the LUT storage unit 310, and ends the gradation adjustment.

<Description of Reference Images>

Next, the reference images 60 and 90 are described. The reference images 60 and 90 are images for setting the measurement timing of the measurement images. If the number of times a sensor output value output from the color sensor 200 exceeds a threshold reaches a predetermined number of times while the reference image 60 (or 90) is passing through the measurement position of the color sensor 200, the sensor control unit 1123 determines that the reference image 60 (or 90) is detected.

Then, according to the fact that the color sensor 200 detects the reference image 60, the sensor control unit 1123 starts measuring an elapsed time. Then, the sensor control unit 1123 controls the color sensor 200 to output a sensor output value from the color sensor 200 if the elapsed time reaches a determined time. Also in a case where the color sensor 200 detects the reference image 90, similarly, the sensor control unit 1123 controls the color sensor 200 to output a sensor output value from the color sensor 200 if an elapsed time reaches a time determined in advance. The determined time (elapsed time) in the maximum density adjustment control and the determined time (elapsed time) in the gradation adjustment control are different from each other.

Further, the reference images 60 and 90 are images having as high densities as possible. This is to prevent the color sensor 200 from erroneously detecting a stain on the sheet 110. If the difference between a sensor output value of the color sensor 200 corresponding to a non-image area of the test chart A or B and a sensor output value of the color sensor 200 corresponding to the reference image 60 or 90 is great, the sensor control unit 1123 can distinguish between the reference image 60 or 90 and a stain with high accuracy.

Further, the sensor control unit 1123 counts the number of times the sensor output value of the color sensor 200 exceeds the threshold. If the counted number of times exceeds the predetermined number of times, the sensor control unit 1123 determines that the reference image 60 (or 90) passes through the measurement position of the color sensor 200. For example, if the density of the reference image 60 (or 90) is low, the counted number of times may not reach the predetermined number of times even though the reference image 60 (or 90) has passed through the measurement position. Consequently, the timing for measuring the measurement images shifts, and the correspondence relationships between sensor output values of the color sensor 200 and the measurement images are not appropriate relationships.

In the present specification, the description is given of the configuration, as a premise, in which if the color sensor 200 measures the reference image 60 or 90, the sensor output value of the color sensor 200 exceeds a threshold. Alternatively, for example, the configuration may be such that if the color sensor 200 measures the reference image 60 or 90, the sensor output value of the color sensor 200 falls below a threshold. In this case, the sensor control unit 1123 counts the number of times the sensor output value of the color sensor 200 falls below the threshold. If the counted number of times exceeds a predetermined number of times, the sensor control unit 1123 determines that the reference image 60 (or 90) passes through the measurement position of the color sensor 200.

To enable the color sensor 200 to detect the reference image 60 or 90 with high accuracy, an image signal value of the reference image 60 or 90 included in the test image data A or B includes the maximum value (FFH) of a black image signal value and the maximum value (FFH) of a cyan image signal value. This increases the amount of developer to be attached to the reference image 60 or 90. Thus, it is possible to form the reference images 60 and 90 as images having high densities.

The intensity of reflected light received by the sensor 202 of the color sensor 200 is "the non-image area of the test chart A or B>a yellow toner image>a magenta toner image>a cyan toner image>a black toner image". Thus, the reference image 60 or 90 is formed using cyan and black toners, whereby the sensor control unit 1123 can detect the reference image 60 or 90 with high accuracy.

Further, there are limitations on the amount of toner that can be transferred onto the sheet 110 and the amount of toner that can be fixed to the sheet 110. Thus, the reference image 60 or 90 is formed using cyan and black toners, whereby the sensor control unit 1123 can detect the reference image 60 or 90 with high accuracy in such a manner that the limitations on the amounts of placed toner are not exceeded.

Next, the lengths in the conveyance direction of the reference images 60 and 90 and the lengths in the conveyance direction of the margins are set as in table 1.

TABLE 1

| | Length of reference image | Length of margin at leading end |
|---|---|---|
| Maximum density adjustment control | 30 mm | 50 mm |
| Gradation adjustment control | 15 mm | 25 mm |

The length in the conveyance direction of the reference image 60 (maximum density adjustment control) is longer than the length in the conveyance direction of the reference image 90 (gradation adjustment control). Further, the length of the margin portion provided on the leading end side in the conveyance direction of the test chart A (maximum density adjustment control) is longer than the length of the margin portion provided on the leading end side in the conveyance direction of the test chart B (gradation adjustment control).

In the maximum density adjustment control, it is necessary to set the image forming conditions so that measurement images having higher densities than an image having a target maximum density estimated from the current environment conditions are formed. This is to determine a laser power for forming an image having a target maximum density based on interpolation from the measurement results of measurement images as described in FIG. 7. This is because an interpolation calculation is more accurate than an extrapolation calculation.

Further, the amount of developer of the reference image is large, it is highly likely that the developer is scattered on the reference image formed on the test chart, or the developer comes off. Thus, if the length in the conveyance direction of the reference image 60 is shortened, the sensor output value of the color sensor 200 may be less than the threshold, and the color sensor 200 may not be able to certainly detect the reference image 60.

For example, the color sensor 200 makes a measurement every 4 milliseconds (msec), and the sensor control unit 1123 determines, as the detection timing, the timing when the sensor output value of the color sensor 200 exceeds the threshold five times. At this time, the amount of developer of the reference image is large in the test chart A for the maximum density adjustment. Thus, the developer may come off. However, the reference image 60 is made sufficiently large, whereby it is possible to certainly determine the detection timing of the reference image 60.

Figures 11A, 11B:
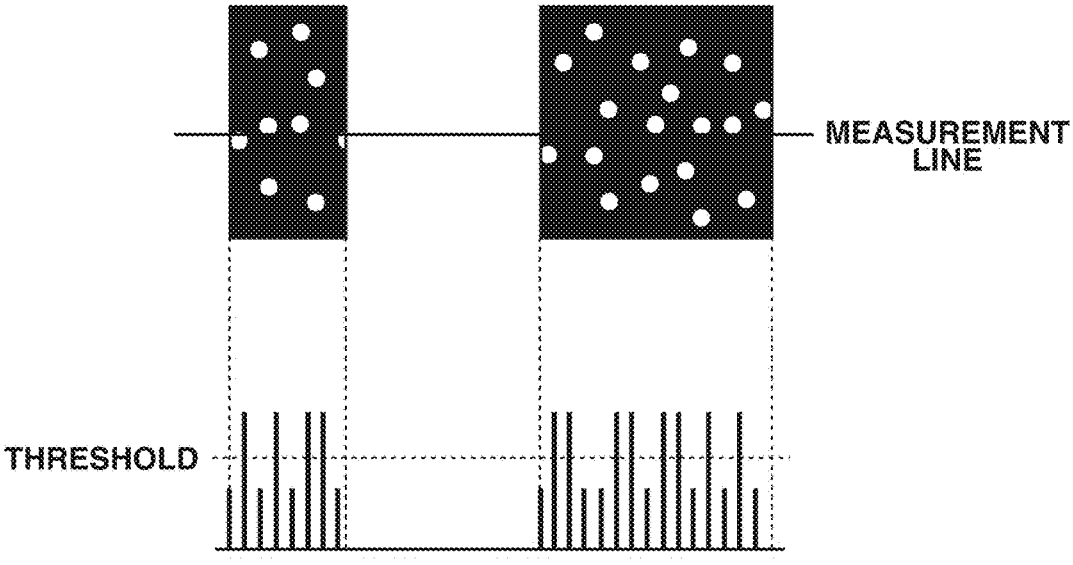
FIG. 11A is a diagram illustrating a reference image in which defective fixing occurs, and detection results.
FIG. 11B is a diagram illustrating a reference image in which defective fixing occurs, and detection results.

FIGS. 11A and 11B illustrate sensor output values output from the color sensor 200 while the reference image is passing through the measurement position of the color sensor 200 in a state where defective fixing occurs. The length in the conveyance direction of the reference image illustrated in FIG. 11A is shorter than the length in the conveyance direction of the reference image illustrated in FIG. 11B. In the reference image illustrated in FIG. 11A, the number of times a detection signal of the color sensor 200 exceeds the threshold is less than five times. Thus, even if a measurement image in which defective fixing occurs passes through the measurement position, the sensor control unit 1123 cannot determine the detection timing.

Figure 12A:
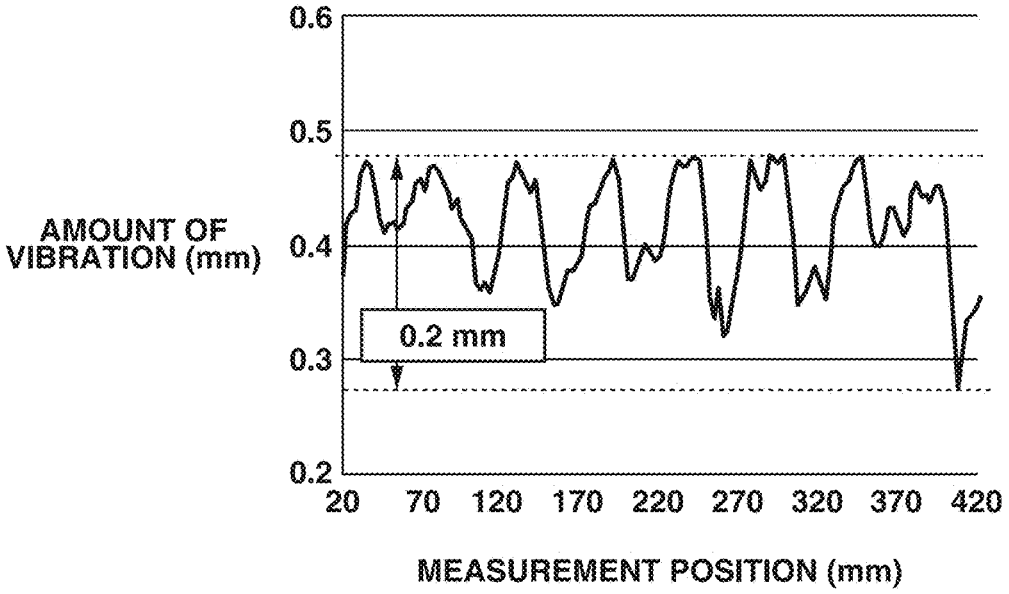
FIG. 12A is a diagram illustrating an experimental result of measuring an amount of change on a surface of a test chart (in a state where an amount of attached toner is larger than a predetermined amount)
Figure 12B:
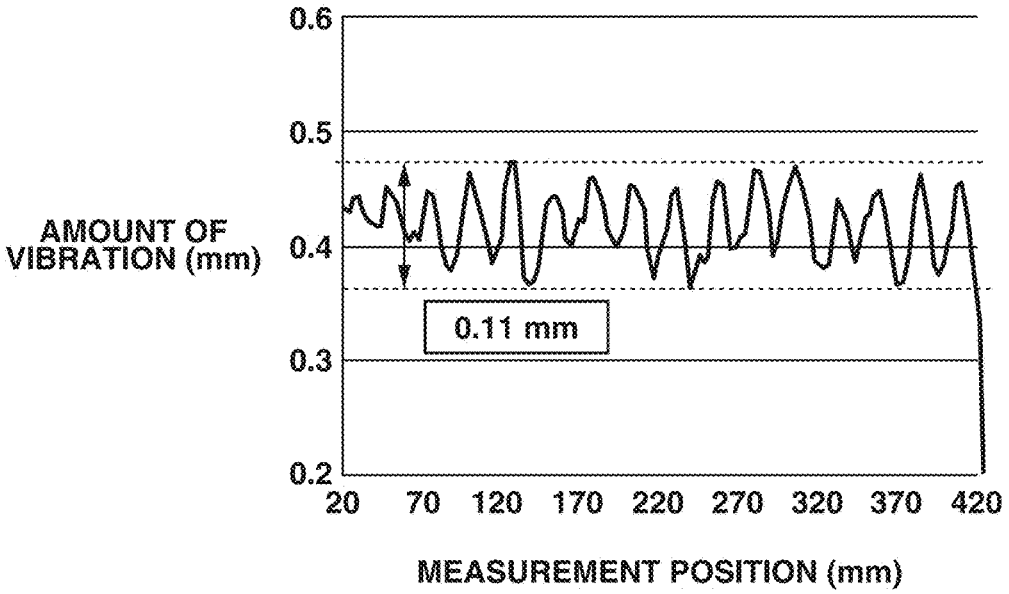
FIG. 12B is a diagram illustrating an experimental result of measuring an amount of change on a surface of a test chart (in a state where an amount of attached toner is smaller than the predetermined amount).

Further, it has been found by experiment that as the amount of developer of an image formed on a sheet increases, the sheet stabilizes and becomes more difficult to convey. FIG. 12A illustrates the result of conveying a sheet to which a large amount of developer is fixed, and measuring the amount of vibration of the sheet that is being conveyed. On the other hand, FIG. 12B illustrates the result of conveying a sheet to which a smaller amount of developer than that in FIG. 12A is fixed, and measuring the amount of vibration of the sheet that is being conveyed.

It is understood that as the amount of developer increases, the amount of vibration of the sheet increases. Consequently, if a large amount of developer is fixed to a sheet, the surface of the sheet may not be settled at the focal position of the color sensor 200, and the sensor output value may not exceed the threshold even though the reference image 60 enters the measurement position of the sensor 200.

Therefore, the length in the conveyance direction of the reference image 60 is made longer than the length in the conveyance direction of the reference image 90. Consequently, it is highly likely that the sensor output value exceeds the threshold, i.e., five or more times while the reference image 60 is passing through the measurement position of the sensor 200. As a result, the sensor control unit 1123 can determine the detection timing of the reference image 60.

Further, in the test chart A, the margin on the leading end side of the sheet is widened. Thus, the reference image 60 enters the measurement position in a state where the conveying rollers 140, which are provided upstream of the color sensor 200 in the conveyance direction, nip the leading end of the sheet. As a result, the color sensor 200 can measure the reference image 60 in the state where the conveying rollers 140 suppress the vibration of the sheet. Thus, the sensor control unit 1123 can certainly determine the detection timing of the reference image 60.

On the other hand, the gradation adjustment control is executed after the image forming conditions are controlled in the maximum density adjustment control. Therefore, the charging bias, the developing bias, and the laser power are controlled to have values suitable for the target maximum density. Thus, the reference image 90 may not subjected to defective fixing. For example, if the laser power used to form the reference image 60 is larger than the laser power used to form the reference image 90, the amount of toner of the reference image 60 may be larger than the amount of toner of the reference image 90. Then, the reference image 60 may be subjected to defective fixing.

According to the present exemplary embodiment, in the gradation adjustment control, it is desirable to increase the number of gradation levels of each measurement image as much as possible. Therefore, it is necessary to make the length in the conveyance direction of the reference image 90 as short as possible, and also make the length from the end of the sheet to the reference image 90 in the conveyance direction as short as possible.

<Measurement Timing>

A description is given of a method in which the sensor control unit 1123 determines the measurement timing of the measurement images based on the detection timing of the reference image 60 or 90.

Figure 10A:
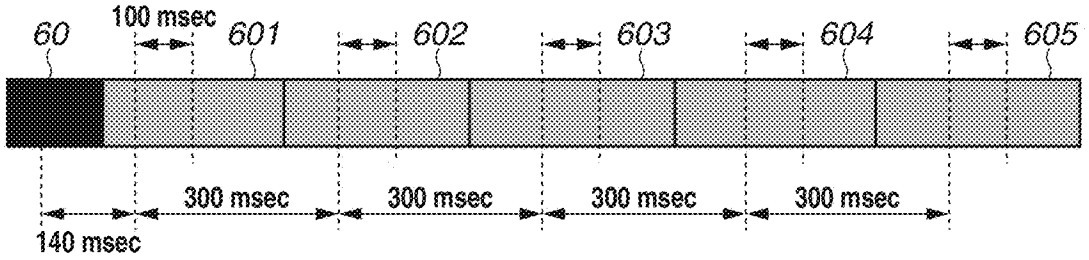
FIG. 10A is a diagram illustrating measurement timing of the test chart A in the maximum density adjustment control (in a state where defective fixing does not occur)
Figure 10B:
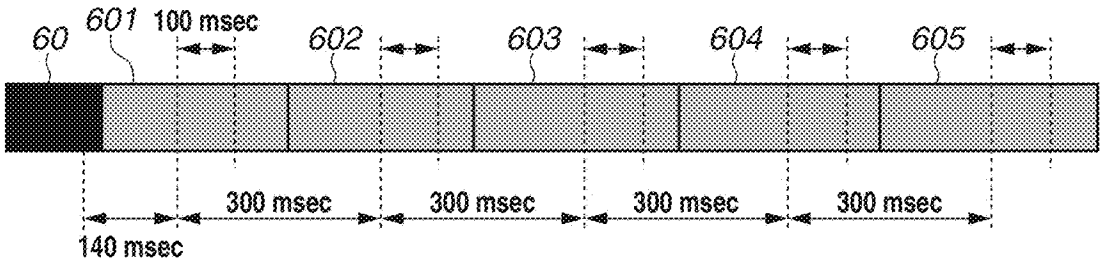
FIG. 10B is a diagram illustrating the measurement timing of the test chart A in the maximum density adjustment control (in a state where defective fixing occurs)

FIGS. 10A and 10B are diagrams illustrating measurement timing in the test chart A printed in the maximum density adjustment control. FIG. 10A illustrates measurement timing in a case where the reference image 60 is detected in a state where defective fixing does not occur. FIG. 10B illustrates measurement timing in a case where the reference image 60 is detected in a state where defective fixing occurs.

The measurement of the measurement image 601 is started 140 msec after the sensor control unit 1123 detects the reference image 60. Each interval in the measurement timing of the measurement images is 300 msec. For each measurement image, a sensor output value is measured 25 times in 100 msec, and the average value of the densities converted by the density conversion unit 1130 is input to the process condition control unit 306.

In the test chart A, the length in the conveyance direction of the reference image 60 is 60 mm. Therefore, it is possible to detect the reference image 60 more certainly. In the test chart A, however, the detection timing of the reference image 60 may greatly change. Therefore, a sufficient margin is provided in the length in the conveyance direction of each measurement image.

Figure 10C:
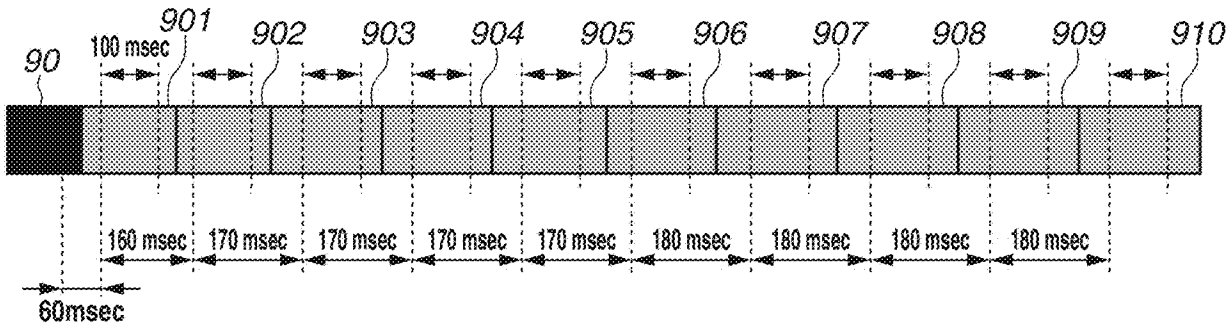
FIG. 10C is a diagram illustrating measurement timing of the test chart B in the gradation adjustment control.

On the other hand, FIG. 10C is a diagram illustrating the measurement timing in the test chart B printed in the gradation adjustment control. The measurement of the measurement image 901 is started 60 msec after the sensor control unit 1123 detects the reference image 90. The interval in the measurement timing from the measurement image 901 to the measurement image 902 is 160 msec. The interval in the measurement timing from the measurement image 902 to the measurement image 906 is 170 msec. The interval in the measurement timing from the measurement image 906 to the measurement image 910 is 180 msec.

In the measurement images formed on the test chart B, the length in the conveyance direction of a measurement image formed at the trailing end of the sheet in the conveyance direction of the sheet is longer than the length in the conveyance direction of a measurement image formed at the leading end of the sheet. Thus, the interval in the measurement timing of two measurement images formed at the trailing end of the sheet is longer than the interval in the measurement timing of two measurement images formed at the leading end of the sheet.

Further, for each measurement image, a sensor output value is measured 25 times in 100 msec, and the average value of the densities converted by the density conversion unit 1130 is input to the LUT generation unit 307.

For the test chart B, the image forming conditions are controlled so that defective fixing does not occur. Therefore, even if the length in the conveyance direction is 30 mm, it is possible to detect the reference image 90 with high accuracy. Thus, it is possible to make the length in the conveyance direction of a measurement image shorter than the length in the conveyance direction of a measurement image formed in the maximum density adjustment control.

According to the present invention, the length in the conveyance direction of the reference image 60 formed in the maximum density adjustment control is made longer than the length in the conveyance direction of the reference image 90 formed in the gradation adjustment control. Therefore, even in a case where defective fixing occurs, it is possible to detect the reference image 60 with high accuracy. Consequently, it is possible to determine the measurement timing of the measurement images 601, 602, 603, 604, and 605 according to the detection timing. Thus, it is possible to prevent the color sensor 200 from erroneously detecting the measurement images 601, 602, 603, 604, and 605.

In the above description, the sensor control unit 1123 determines the measurement timing of the measurement images based on the detection timing of the reference image, and the sensor control unit 1123 outputs sensor output values of the color sensor 200 at the measurement timing. Alternatively, the color sensor 200 may output sensor output values based on a predetermined measurement interval and extract, from data of the sensor output values, sensor output values corresponding to the measurement images. The sensor control unit 1123 determines the correspondence relationships between positions on the test chart and sensor output values based on the measurement result of the reference image and selects sensor output values corresponding to the positions of measurement images from among a plurality of sensor output values corresponding to one page of the test chart. Then, as described above, the sensor control unit 1123 determines image forming conditions based on the sensor output values corresponding to the respective measurement images and generates a γ LUT.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154349, filed Aug. 4, 2015, which is hereby incorporated by reference herein in its entirety.

What is claimed is:

1. An image forming apparatus comprising:

a gradation correction unit configured to convert image data based on a conversion condition;

an image forming unit configured to form an image based on the image data converted by the gradation correction unit and fix the image to a sheet;

a conveyance unit configured to convey the sheet;

a measurement unit configured to measure the image formed on the sheet conveyed by the conveyance unit; and a controller configured to:

control the image forming unit to create a first test sheet, wherein first reference image and first measurement images are formed on the first test sheet, control the conveyance unit to convey the first test sheet, control the measurement unit to measure the first reference image and the first measurement images on the first test sheet, determine first information regarding positions of the first measurement images on the first test sheet based on measurement results of the first reference image by the measurement unit, adjust an image forming condition based on a first measurement result corresponding to a measurement result of the first test sheet measured by the measurement unit based on the first information, control the image forming unit to create a second test sheet, wherein second reference image and second measurement images are formed on the second test sheet, control the conveyance unit to convey the second test sheet, control the measurement unit to measure the second reference image and the second measurement images on the second test sheet, determine second information regarding positions of the second measurement images on the second test sheet based on measurement results of the second reference image by the measurement unit, and generate the conversion condition based on a second measurement result corresponding to a measurement result of the second test sheet measured by the measurement unit based on the second information, wherein a length of the first reference image in a direction in which the first test sheet is conveyed is longer than a length of the second reference image in a direction in which the second test sheet is conveyed.

2. The image forming apparatus according to claim 1, wherein a length from a leading end of the first test sheet to the first reference image in the direction in which the conveyance unit conveys the first test sheet is longer than a length from a leading end of the second test sheet to the second reference image in the direction in which the conveyance unit conveys the second test sheet.

3. The image forming apparatus according to claim 1, wherein the image forming unit includes a first image forming unit configured to form an image using a black developer, and a second image forming unit configured to form an image using a developer of another color different from the black developer, and wherein the first reference image and the second reference image are formed using the black developer.

4. The image forming apparatus according to claim 3, wherein the developer of another color is cyan developer, wherein the first measurement images and the second measurement images include measurement images formed using the black developer by the first image forming unit, and other measurement images formed using the cyan developer by the second image forming unit, and wherein the first reference image and the second reference image are formed using both the black developer and the cyan developer.

5. The image forming apparatus according to claim 1, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement images include a first pattern image formed based on a first charging voltage with which the charging unit charges the photosensitive member and a second pattern image formed based on a second charging voltage with which the charging unit charges the photosensitive member, and wherein the first charging voltage and the second charging voltage are different with each other.

6. The image forming apparatus according to claim 1, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement images include a first pattern image formed based on a first intensity of exposure light of the exposure unit and a second pattern image formed based on a second intensity of exposure light of the exposure unit, and wherein the first intensity and the second intensity are different with each other.

7. The image forming apparatus according to claim 1, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement images include a first pattern image formed based on a first developing bias to be applied to the development unit and a second pattern image formed based on a second developing bias to be applied to the development unit, and wherein the first developing bias and the second developing bias are different with each other.

8. The image forming apparatus according to claim 1, wherein the image forming unit includes a fixing unit having a heater configured to fix the image to the sheet by heat.

9. A method for an image forming apparatus, the method comprising:

converting image data based on a conversion condition;

using an image forming unit to form an image based on the converted image data and fix the image to a sheet;

controlling the image forming unit to create a first test sheet and a second test sheet, wherein first reference image and first measurement images are formed on the first test sheet, and second reference image and second measurement images are formed on the second test sheet;

conveying the first test sheet and the second test sheet;

measuring the first reference image and the first measurement images on the conveyed first test sheet and measuring the second reference image and the second measurement images on the conveyed second test sheet;

determining first information regarding positions of the first measurement images on the first test sheet based on measurement results of the first reference image and determining second information regarding positions of the second measurement images on the second test sheet based on measurement results of the second reference image;

adjusting an image forming condition based on a first measurement result corresponding to a measurement result of the measured first test sheet based on the first information; and generating the conversion condition based on a second measurement result corresponding to a measurement result of the measured second test sheet based on the second information, wherein a length of the first reference image in a direction in which the first test sheet is conveyed is longer than a length of the second reference image in a direction in which the second test sheet is conveyed.

10. An image forming apparatus comprising:

an image forming unit configured to form an image on a sheet and fix the image on the sheet;

a conveyance unit configured to convey the sheet along a conveyance path;

a measurement unit provided to the conveyance path and configured to measure the image formed on the sheet conveyed by the conveyance unit; and a controller configured to:

control the image forming unit to form a first trigger image and a first measurement image on a first sheet, control the conveyance unit to convey the first sheet, control the measurement unit to measure the first trigger image and the first measurement image on the first sheet, determine a first measurement timing based on the measurement result of the first trigger image measured by the measurement unit, generate a first image forming condition from the measurement result of the first measurement image measured by the measurement unit based on the first measurement timing, control the image forming unit to form a second trigger image and a second measurement image on a second sheet, control the conveyance unit to convey the second sheet, control the measurement unit to measure the second trigger image and the second measurement image on the second sheet, determine a second measurement timing based on the measurement result of the second trigger image measured by the measurement unit, generate a second image forming condition from the measurement result of the second measurement image measured by the measurement unit based on the second measurement timing, wherein a length of the first trigger image in a direction in which the first sheet is conveyed is longer than a length of the second trigger image in a direction in which the second sheet is conveyed.

11. The image forming apparatus according to claim 10, wherein the measurement unit measures the first trigger image on the first sheet while the conveyance unit conveys the first sheet, and measures the second trigger image on the second sheet while the conveyance unit conveys the second sheet.

12. The image forming apparatus according to claim 10, wherein the first trigger image and the first measurement image on the first sheet conveyed by the conveyance unit pass through a measurement area of the measurement unit and the second trigger image and the second measurement image on the second sheet conveyed by the conveyance unit pass through the measurement area of the measurement unit.

13. The image forming apparatus according to claim 10, wherein the controller controls the image forming unit to form the first trigger image and the first measurement image on the first sheet where passing through the measurement area of the measurement unit, and controls the image forming unit to form the second trigger image and the second measurement image on the second sheet where passing through the measurement area of the measurement unit.

14. The image forming apparatus according to claim 10, wherein the first image forming condition corresponds to a condition for adjusting a maximum density of an image to be formed by the image forming unit.

15. The image forming apparatus according to claim 10, wherein the second image forming condition corresponds to a condition for adjusting a gradation characteristic of an image to be formed by the image forming unit.

16. The image forming apparatus according to claim 10, wherein a length from a leading end of the first test sheet to the first trigger image in the direction in which the conveyance unit conveys the first test sheet is longer than a length from a leading end of the second test sheet to the second trigger image in the direction in which the conveyance unit conveys the second test sheet.

17. The image forming apparatus according to claim 10, wherein the controller controls the image forming unit to form the first trigger image and the second trigger image by using a black developer.

18. The image forming apparatus according to claim 10, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement image include a first pattern image formed based on a first charging voltage with which the charging unit charges the photosensitive member and a second pattern image formed based on a second charging voltage with which the charging unit charges the photosensitive member, and wherein the first charging voltage and the second charging voltage are different with each other.

19. The image forming apparatus according to claim 10, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement image include a first pattern image formed based on a first intensity of exposure light of the exposure unit and a second pattern image formed based on a second intensity of exposure light of the exposure unit, and wherein the first intensity and the second intensity are different with each other.

20. The image forming apparatus according to claim 10, wherein the image forming unit includes:

a photosensitive member, a charging unit configured to charge the photosensitive member, an exposure unit configured to expose the charged photosensitive member to form an electrostatic latent image, and a development unit configured to develop the electrostatic latent image using a developer, wherein the first measurement image include a first pattern image formed based on a first developing bias to be applied to the development unit and a second pattern image formed based on a second developing bias to be applied to the development unit, and wherein the first developing bias and the second developing bias are different with each other.

* * * * *